US008960115B2

(12) United States Patent
Frisky

(10) Patent No.: US 8,960,115 B2
(45) Date of Patent: Feb. 24, 2015

(54) WATER PROPELLED PERSONAL CRAFT

(71) Applicant: Sean Frisky, Regina (CA)

(72) Inventor: Sean Frisky, Regina (CA)

( * ) Notice: Subject to any disclaimer, the term of this patent is extended or adjusted under 35 U.S.C. 154(b) by 37 days.

(21) Appl. No.: 13/757,414

(22) Filed: Feb. 1, 2013

(65) Prior Publication Data

US 2014/0216319 A1 Aug. 7, 2014

(51) Int. Cl.

| | |
|---|---|
| ***B63H 11/00*** | (2006.01) |
| ***B63B 35/73*** | (2006.01) |
| ***B64C 39/02*** | (2006.01) |
| *B63H 11/10* | (2006.01) |

(52) U.S. Cl.

CPC ..... *B63B 35/731* (2013.01); *B64C 39/026* (2013.01); *B63H 11/10* (2013.01); *B63H 2011/006* (2013.01)

USPC ..... 114/55.58; 440/39

(58) Field of Classification Search

USPC ..... 114/55.58; 440/39

IPC ..... B63H 11/08

See application file for complete search history.

(56) References Cited

U.S. PATENT DOCUMENTS

| | | | | |
|---|---|---|---|---|
| 1,943,152 | A * | 1/1934 | Weiss | 239/1 |
| 4,541,357 | A | 9/1985 | Stanton | |
| 6,178,905 | B1 | 1/2001 | Dynes et al. | |
| 6,722,679 | B2 * | 4/2004 | Englert | 280/288.4 |
| 7,614,355 | B2 * | 11/2009 | Zeyger | 114/55.58 |
| 7,900,867 | B2 | 3/2011 | Li | |

* cited by examiner

*Primary Examiner* — Stephen Avila

(74) *Attorney, Agent, or Firm* — Craig J. Lervick; Larkin Hoffman Daly & Lindgren, Ltd.

(57) ABSTRACT

A vehicle for use on the water that can be propelled into the air above the water is provided. The vehicle can include a main body, a board provided on the bottom of the main body, a seat, an inlet for receiving a pressurized incoming water stream, a main nozzle positioned to direct a flow of water beneath the board, handlebars having handle conduits, each handle conduit ending in a nozzle for discharging a flow of water out of the handle conduit and rotatable relative to the vehicle, and conduits supported by the main body, the conduits connected to the inlet and positioned to route a first portion of the incoming water stream to the main nozzle and a second portion of the incoming water stream to the handlebars. The water stream can be supplied to the vehicle from an outlet on a personal water craft.

12 Claims, 8 Drawing Sheets

WATER PROPELLED PERSONAL CRAFT

The present invention relates to a water propelled vehicle capable of flight.

BACKGROUND

Recreational water sports that involve powered vehicles are quite popular. For example, personal water crafts (PWCs) that allow one or more riders to sit on the personal water craft and travel over water have become quite popular and you can often see them being used at lakes, oceans or other bodies of water. There are also many types of water sports that involve a tow vehicle such as a boat or PWC towing a person over the surface of the water with the person riding on water skis, a wakeboard, etc.

The popularity of these water based activities is likely a result of many different factors. However, all these activities tend to involve relatively warm weather and getting wet. Additionally, the fact that if a person were to fall in the water the water is much more forgiving then if they were to fall on land, likely has something to do with the popularity of these activities.

More recently, there have been some devices, such as the personal propulsion device described in U.S. Pat. No. 7,900,867 to Li, that combine water sports with the ability of the user's operating the device to be lifted into the air like they were flying. The Li device for instance discloses a personal propulsion device that includes a body unit that a person is strapped into and then uses jets of water to allow the operator to be propelled into the air above a surface of a water suspended in the air by these jets of water. The use of this device over water not only provides a source of propulsion (the water in the lake, ocean, etc. being pumped to the device to create the jets of water being discharged from the device), but if the operator crashes the device, their crash into the water is much softer than if they were to crash into the ground.

However, the device described by Li does have disadvantages. It is quite cumbersome and requires the operator to be strapped to the body unit, preventing them from easily releasing themselves from the device. Additionally, if the person were to crash into the surface of the water, although it would be softer than crashing into ground, the operator would almost certainly find themselves underwater and strapped to the body unit. Additionally, the controls of the body unit may seem foreign to a new operator and it might take some time for a new operator to get the hang of operating the device.

SUMMARY OF THE INVENTION

In an aspect, a vehicle that can ride on a surface of water and be propelled into the air above the surface of the water is provided. The vehicle can include: a main body; a board provided on the bottom of the main body; a seat; an inlet for receiving a pressurized incoming water stream from a water source; a main nozzle positioned to direct a flow of water beneath the board; handlebars having a first handle conduit and a second handle conduit, each handle conduit ending in a nozzle for discharging a flow of water out of the handle conduit and rotatable relative to the vehicle; and conduits supported by the main body, the conduits connected to the inlet and positioned to route a first portion of the incoming water stream to the main nozzle and a second portion of the incoming water stream to the handlebars.

The vehicle allows a rider to simply climb on the vehicle, placing a leg over either side of the seat and hold onto handles on the handle bars. A pressurized water stream is supplied to the vehicle from a water source, such as through a hose connected to the outlet of a personal water craft, and this pressurized water source is routed to a number of outlets on the vehicle, including one directed beneath the vehicle and two directed out the ends of the handlebars. The rider can rotate the handlebars to alter the direction of thrust created by the water being discharged out the ends of the handlebars, allowing the rider to control the direction of propulsion, causing the vehicle to move backwards forwards and even be propelled up into the air.

DESCRIPTION OF THE DRAWINGS

A preferred embodiment of the present invention is described below with reference to the accompanying drawings, in which.

DETAILED DESCRIPTION OF THE ILLUSTRATED EMBODIMENTS

Figure 1:
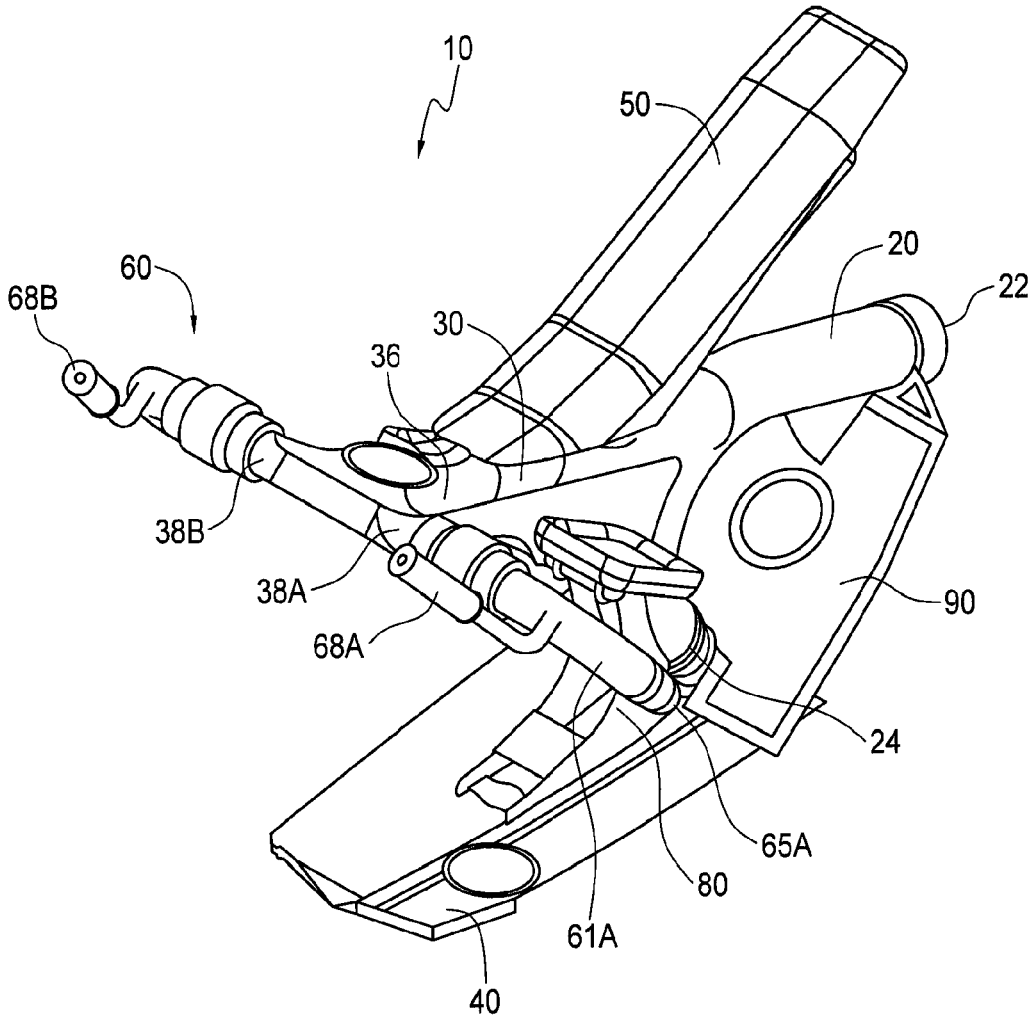
FIG. 1 illustrates a perspective view of the vehicle.

FIG. 1-5 illustrate a water propelled vehicle 10. The vehicle 10 can be used on a body of water such as a lake, pond, ocean, etc. and connected to a pressurized water source to allow the bike to be propelled into the air, a significant distance above the surface of the water using this pressurize water to create thrust. The rider can direct some of this thrust to control the height and direction the vehicle 10 is propelled.

The vehicle 10 can have frame 80, a main conduit 20, a second conduit 30, a board 40, a seat 50 and handlebars 60. The frame 80 can be used to support the main conduit 20, second conduit 30 and the board 40 in position relative to one another. The seat 50 can be provided extending at an angle upwards from the second conduit 30 to provide the rider with a place to sit while they are operating the vehicle 10. Typically, the seat 50 will be provided with padding for the comfort of the rider. The seat 50 can be positioned so that the rider can straddle the seat 50 with one foot on either side of the vehicle 10. A plate 90 can be provided so that the rider can rest their feet on the plate 90 while he or she is operating the vehicle 10. The board 40 can be positioned on the bottom of the vehicle 10 so that it comes in contact with the water surface and can aid in keeping the vehicle 10 floating on the surface of the water when the rider is not propelling the vehicle 10 upwards into the air.

The vehicle 10 can be propelled by pressurized streams of water that exit generally below the board 40 of the vehicle 10 and through the ends of the handlebars 60 creating thrust to propel the vehicle 10. The thrust generated by the water stream directed generally below the vehicle 10 can help keep the vehicle 10 floating on the surface of the water when the rider is not using the additional thrust of the water streams being discharged from the handlebars 60 to propel the vehicle 10 upward into the air. The rider can rotate the handlebars 60 relative to the main body 80 of the vehicle 10 to control the direction of the streams of water being discharged from the handlebars 60 and cause the bike to be propelled backwards, forwards, upwards and even downwards.

Figure 5:
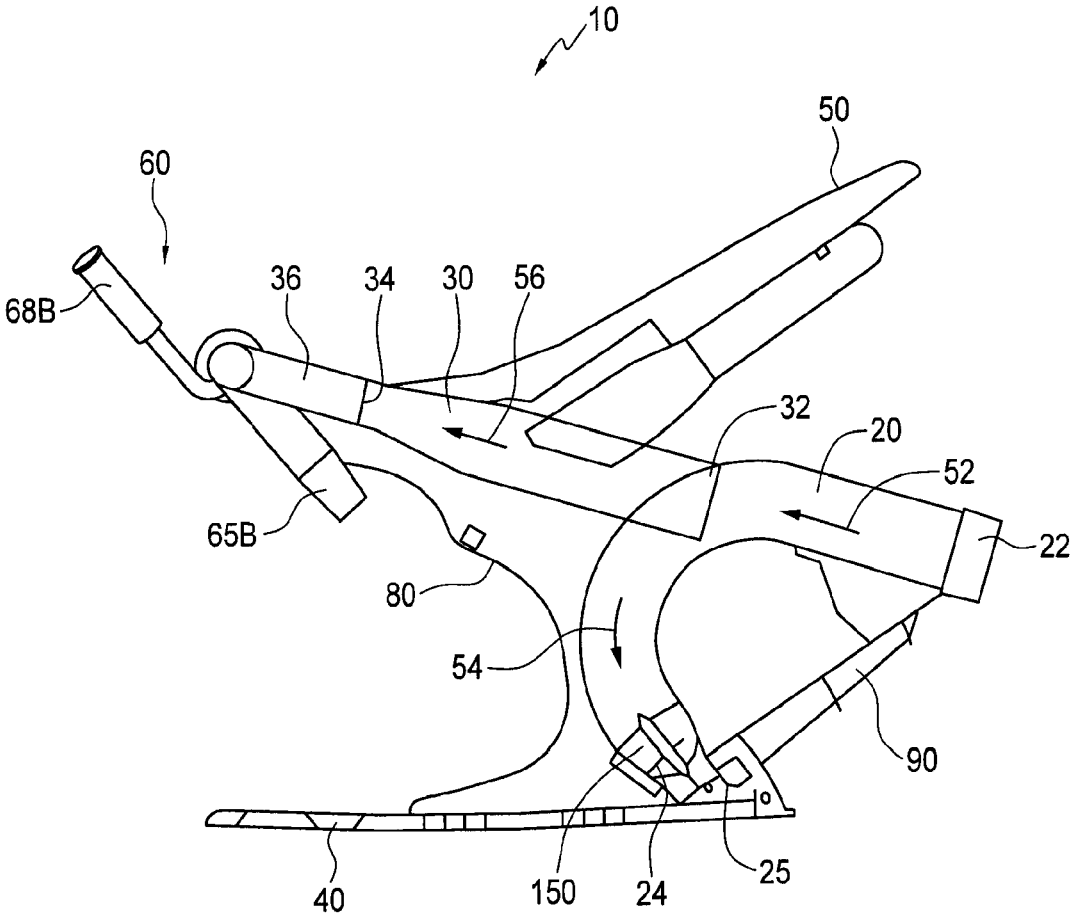
FIG. 5 illustrates a side section view of the vehicle taken along line AA in FIG. 4.

Referring to FIG. 5, the main conduit 20 can be used to take an incoming water stream 52 and direct a first portion 54 of the water stream 52 through the main conduit 20 and below the vehicle 10. A second portion 56 of the water stream 52 is routed through the second conduit 20 to the handlebars 60. The main conduit 20 can have an inlet 22 and an outlet 24. The inlet 22 can be connected to a pressurized water source (not shown) so that the water stream 52 is introduced into the main conduit 20 through the inlet 22 of the main conduit 20. The main conduit 22 can then direct this water flow 52 so that the first portion 54 of the water flow is directed through the length of the main conduit 20 to exit out the outlet 24 of the main conduit 20, directed generally beneath the vehicle 10 to create thrust and keep the vehicle 10 positioned on the surface of the water. The main nozzle 24 can also be directed slightly rearwardly so the thrust created by water flowing out the main nozzle 24 also tends to propel the vehicle 10 slightly forwards in addition to upwards.

A main nozzle 25 can be provided on the outlet 24 of the main conduit 20 to increase the thrust created by the pressurized second portion 54 of the water stream exiting the main tube 20. The main tube 20 can be curved so that the main nozzle 25 is directed below the vehicle 10 so that the thrust created by the water exiting the main nozzle 25 propels the bike 10 generally upwards and keeps the bike 10 on the water surface.

Figure 6:
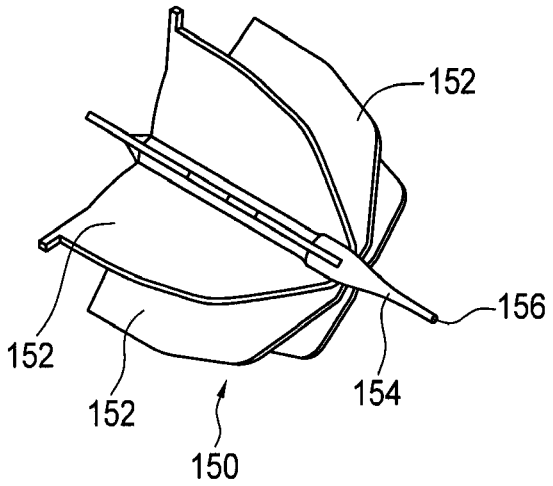
FIG. 6 illustrates a straightening vane for use in a main outlet of the vehicle.

A main straightening vane 150 can be provided at the outlet 24 of the main conduit 20 to smooth out the flow of the first portion 54 of the water stream before it is discharged out the main nozzle 25 to increase the thrust produced as it exits the main nozzle 25. FIG. 6 illustrates the main straightening vane 150 in isolation. The straightening vane 150 can include a number of vane members 152 that extend radially outwards from a spindle 154. As water flows through the straightening vane 150 and along the vane member 152, the straightening vane 150 and the vane members 152 straighten out the flow of the water and reduce turbulence in the flow of water exiting the main nozzle 25. The spindle 154 can narrow to a point 156 on a downstream side of the spindle to try and minimize the impact the spindle 154 has to the flow of water as it passes through the straightening vane 150 and past the point 156.

Referring again to FIG. 5, the main conduit 20 can also direct the second portion 56 of the water stream 52 to the handlebars 60 where this second stream 56 will be discharged out through the handlebars 60, creating thrust which can be directed by the rider to propel the vehicle 10, forwards, backwards and upwards into the air.

The second conduit 30 has an inlet end 32 and an outlet end 34 and can be used to route the second portion 56 of the water stream 52 out of the main conduit 20 and up to the handlebars 60. The inlet end 32 of the second conduit 30 can be positioned so that it passes into the first conduit 20 so that a second portion 56 of the incoming water stream 52 is routed through the inlet 32 of the second conduit 30 where it is routed by the second conduit 20 to the outlet end 34 of the second conduit 30. The outlet end 34 of the second conduit 30 can be connected to a manifold 36 that splits this second portion 56 of the water stream 52 into a first conduit 38A and a second conduit 38B to direct this second portion 56 of the flow of water through these two conduits 38A, 38B and into the handlebars 60.

The position of the inlet end 32 of the second conduit 30 in the main conduit 20 and the size of the inlet end 32 and second conduit 30 can determine how much of the water stream 52 is the first portion 54 and how much is the second portion 56.

Figure 2:
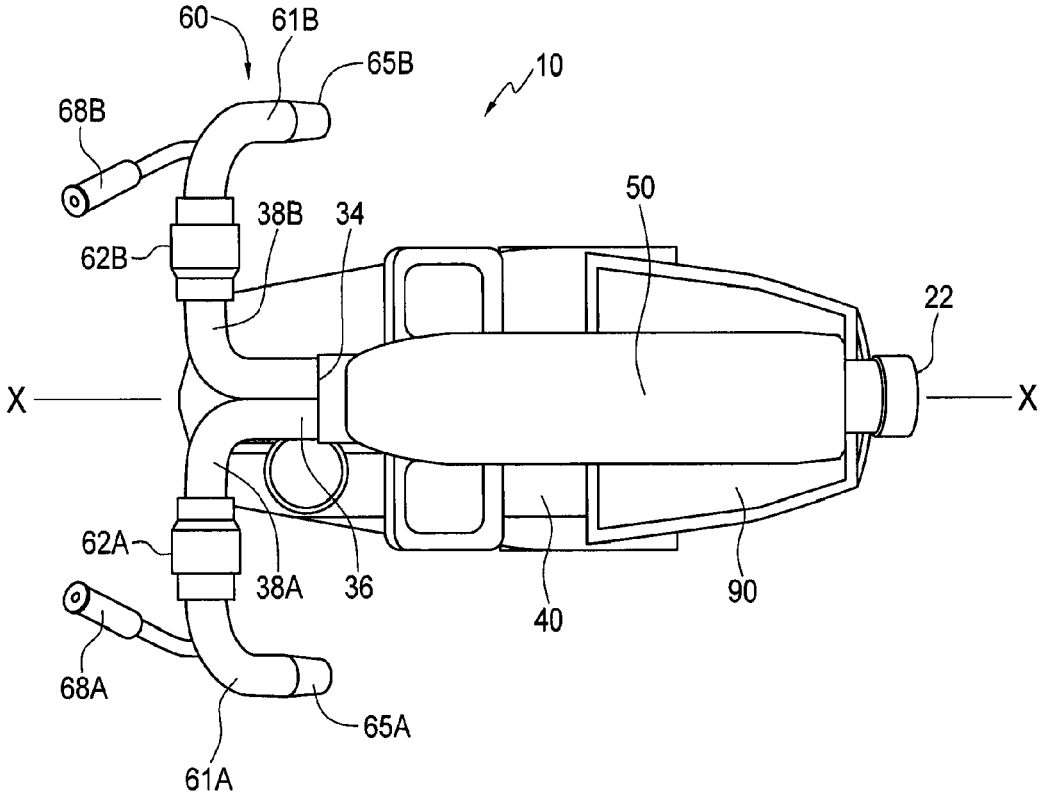
FIG. 2 illustrates a top view of the vehicle.
Figure 3:
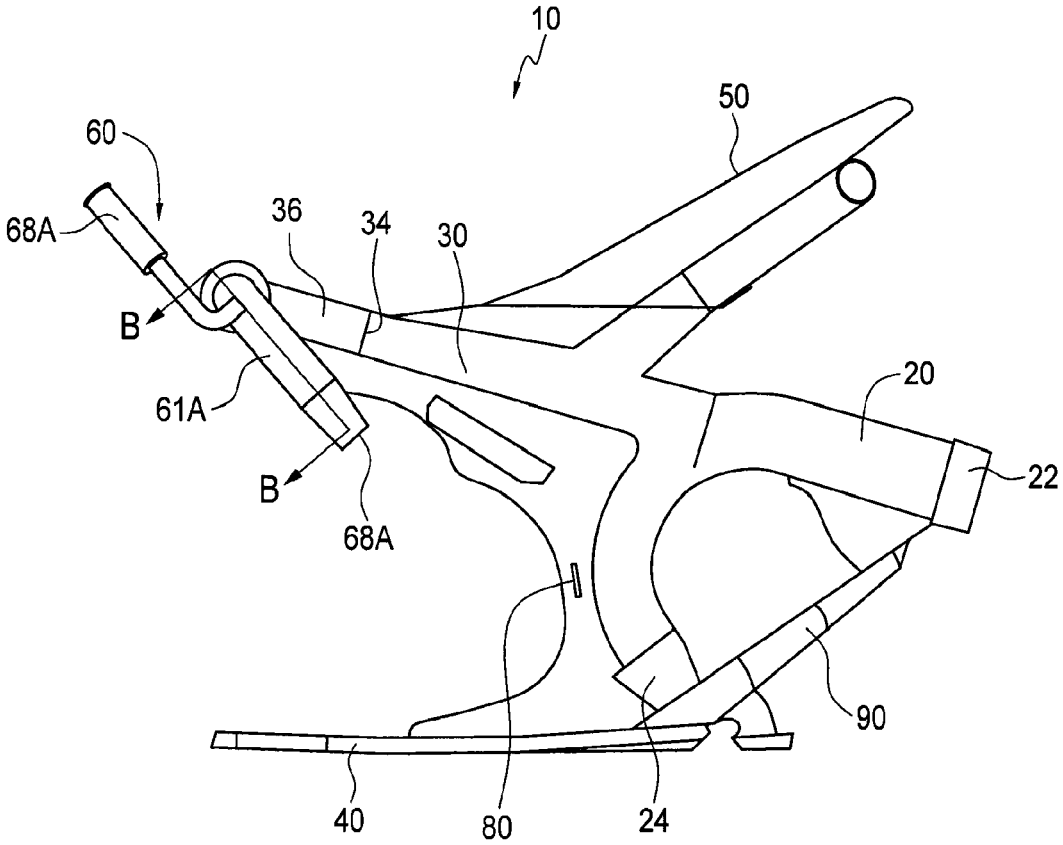
FIG. 3 illustrates a side view of the vehicle.
Figure 4:
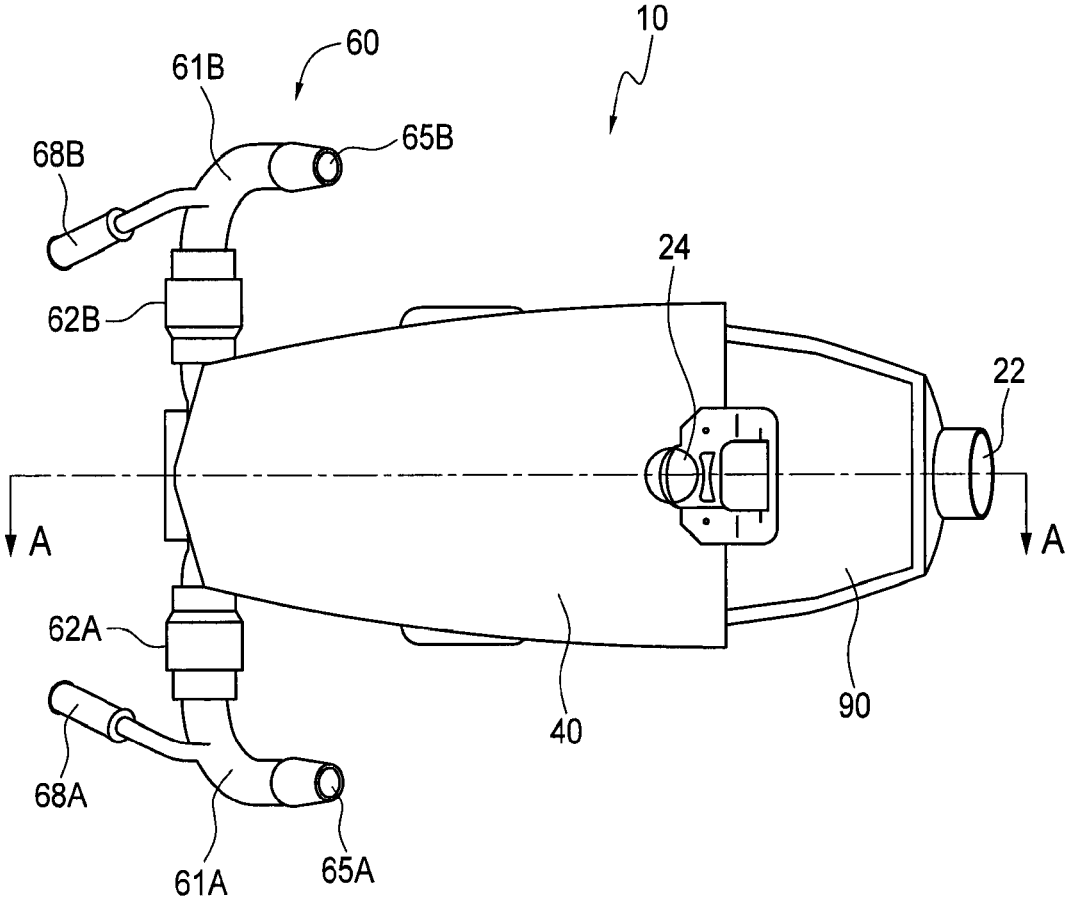
FIG. 4 illustrates a bottom view of the vehicle.
Figure 7:
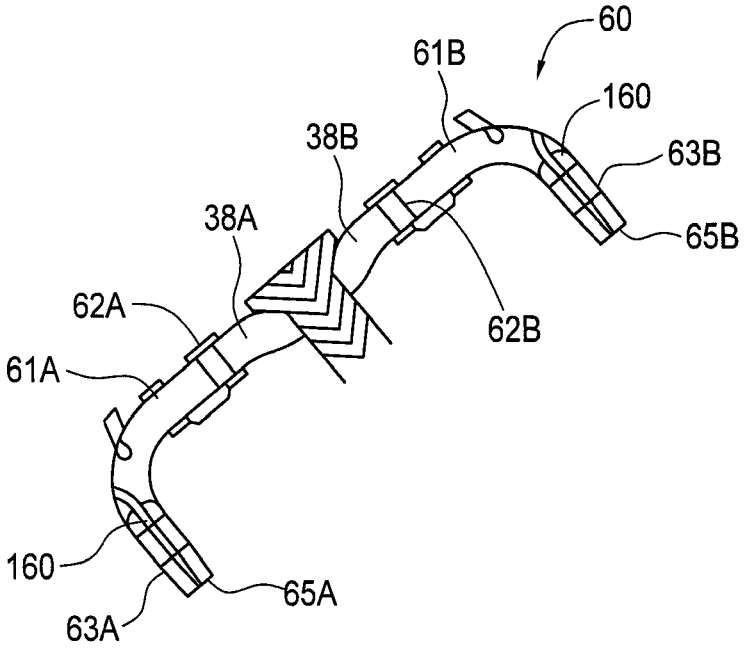
FIG. 7 illustrates a top sectional view of the handlebars along line BB' in FIG. 3.
Figure 8:
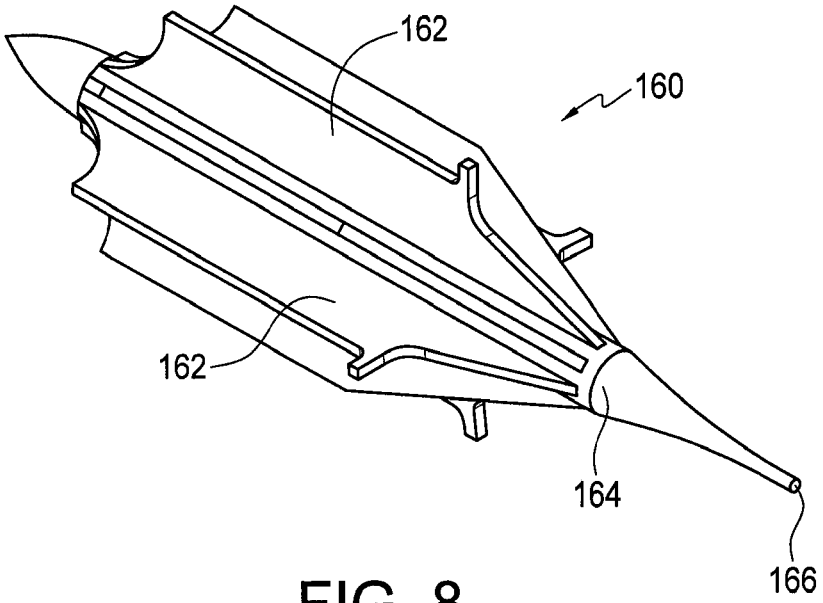
FIG. 8 illustrates nozzle straightening vane for use in the handle tube of the vehicle.

Referring to FIGS. 2 and 7, the handle bars 60 can comprise handle conduits 61A, 61B pivotally connected at first ends 62A, 62B to the first and second conduits 38A, 38B of the manifold 36. In this manner, the second portion 56 of the incoming water stream 52 that passes through the second conduit 30 and into the manifold 36 is split up and directed into the handle conduits 61A, 61B, where it will flow through the lengths of the handle tubes 61A, 61B before being discharged through handle nozzles 65A, 65B on second ends 63A, 63B of the handle conduits 61A, 61B.

Each handle conduit 61A, 61B is rotatably connected to the first and second conduits 38A, 38B so that the handle conduit 61A, 61B can be rotated relative to the rest of the vehicle 10. Each handle conduit 61A, 61B can curve along its length so that the handle nozzles 65A, 65B discharge in planes that lie generally parallel to center line XX'. Additionally, the rotation of the handle conduits 61 allows the handle nozzles 65A, 65B to rotate through these planes, thereby allowing a rider to rotate the handle tubes 61A, 61B so that water can be discharged from the handle nozzles 65A, 65B in up to a 360° circle that is generally parallel to the center line XX', controlling the direction of propulsion from the thrust provided by the handlebars 60.

A nozzle straightening vanes 160 can be provided proximate the ends 63A, 64B of the nozzle conduits 61A, 61B to smooth out the flow of water being discharged out the handle nozzles 65A, 65B to increase the thrust produced by it. FIG. 6 illustrates one of the nozzle straightening vanes 160 in isolation. The straightening vane 160 can include a number of vane members 162 that extend radially outwards from a spindle 164. As water flows through the straightening vane 160 and along the vane member 162, the straightening vane 160 and the vane members 162 can straighten out the flow of the water and reduce turbulence in the flow of water exiting the handle nozzle 65A, 65B. The spindle 164 can narrow to a point 166 on a downstream side of the spindle to try and minimize the impact the spindle 164 has to the flow of water as it passes through the straightening vane 160 and past the point 166.

Referring again to FIGS. 2 and 7, handles 68A, 68B can be provided extending from the handle tubes 61A, 61B so that a user can grasp the handles 65A, 65B and use them to rotate the handle tubes 61A, 61B and direct the flow of water discharging from the nozzles 65A, 65B on the ends of the handle tubes 61A, 61B.

Figure 9:
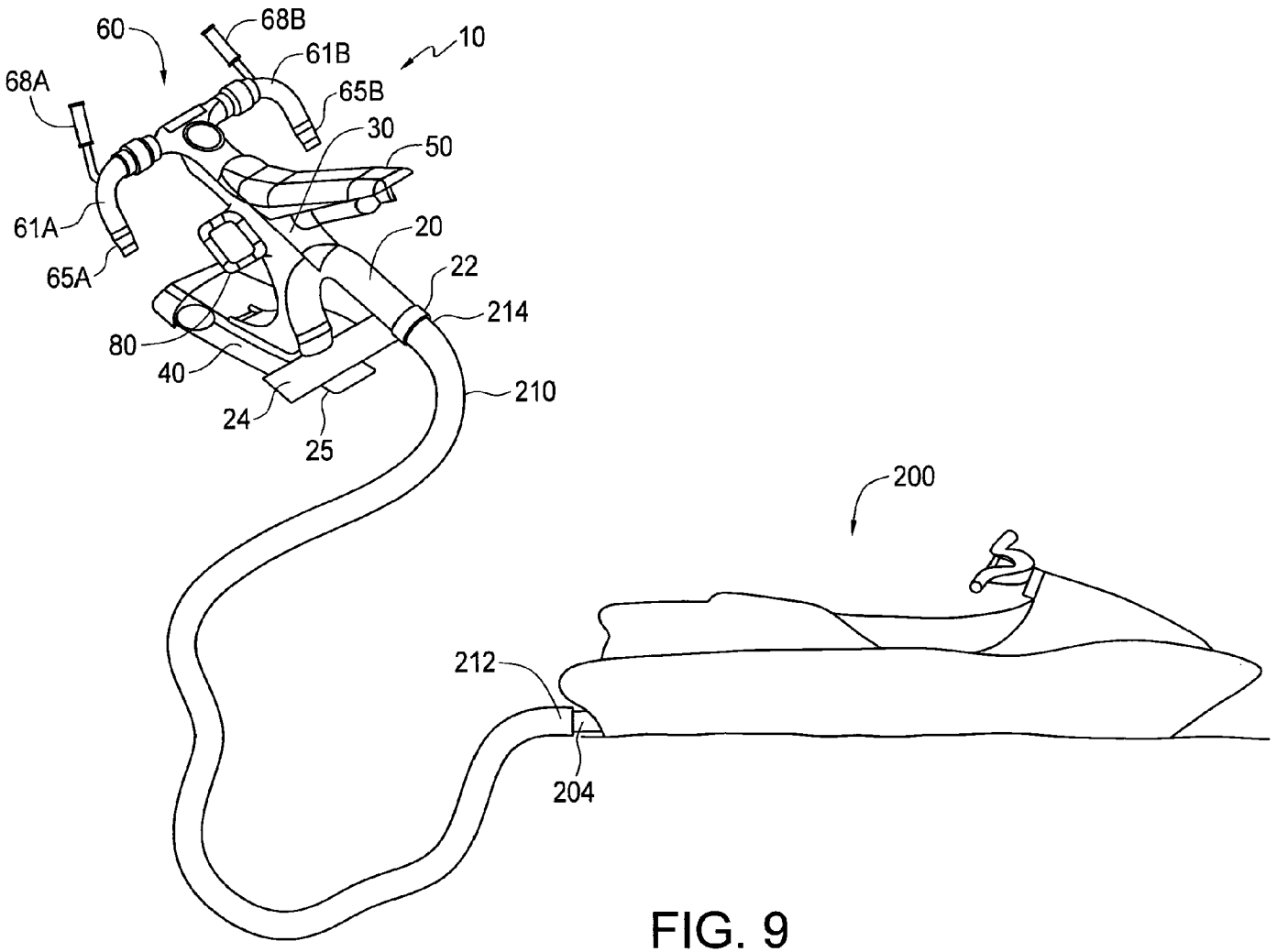
FIG. 9 illustrates the vehicle connected to a personal watercraft.

Referring to FIG. 9, the vehicle 10 is shown connected to a personal water craft 200 so that the personal water craft 200 can supply the vehicle 10 with a pressurize stream of water. Personal water crafts are commonly available under such names as Jet Ski™, Sea-Doo™, etc. A rider sits on top of the personal water craft 200 while an inboard engine drives a pump jet to take water in, compress it and force it out an outlet 204 as on the back of the personal water craft 200 as a pressurized stream of water to create thrust to propel and steer the personal water craft 200 However, FIG. 9 shows a hose 210 connected at a first end 212 to the outlet 204 on the personal watercraft 200 and a second end 224 of the hose 220 is connected to the inlet end 22 of the main conduit 20 on the vehicle 10. In this manner, instead of the pressurized stream of water being used to propel the personal watercraft 200, the stream of water is instead routed through the hose 210 to provide the vehicle 10 with a source of pressurized water which it will then redirect out the main nozzle 24 and the handle nozzles 65B. An person operating the personal watercraft 200 can increase or decrease amount of the stream of water being routed to the vehicle 10 by use of the throttle of the personal watercraft 200.

In operation, a rider will sit on the vehicle 10 so that he or she is sitting on the seat 50 with his or her legs on either side of the main body 80. The rider grasps the handles 65A, 65B on the handlebars 60 and can rest his or her feet on the plate 90 or the board 40. When a pressurized stream of water is discharged from the outlet 104 on the personal watercraft 200 this pressurize stream of water is routed through the hose 210 and to the main conduit 20 of the vehicle 10.

Once in the main conduit 20 the water stream 52 is divided into the first portion 54 which is directed out the main nozzle 24 aimed below the board 40 and the second portion 56 of the water stream 52 is directed into the secondary conduit 30 where it is directed to the handlebars 60 and discharged out the handlebar nozzles 65A, 65B.

The water being discharged out the main nozzle 24 can be used to create enough upward thrust so that the board 40 is maintained on the surface of the water by just the thrust coming from the main nozzle 24.

The rider can rotate the handle tubes 61A, 61B to control the direction the streams of water are exiting from the handle nozzles 65A, 65B and thereby control the vehicle 10. By aiming the handle tubes 61A, 61B so that the handle nozzles 65A, 65B are directed downwards, the rider increase the upward thrust created by the streams of water being discharged out of the vehicle 10, causing the vehicle 10 to be propelled into the air. By aiming them backwards, the rider can propel the vehicle 10 forwards and by aiming them forwards, the rider can propel the vehicle 10 backwards. If the rider rotates the handle tubes 61A, 61B in different directions so that one handle nozzle 65A, 65B is directed forwards while the other is directed backwards, the rider can cause the vehicle 10 to spin. The rider can also aim the handle nozzles 65A, 65B so that the vehicle dives under the surface of the water.

The rider can also use his or her weight to tilt the vehicle 10 to either side, changing the direction of thrust from the main nozzle 24 and the handle nozzles 65A, 65B to propel the bike to either side.

An operator on the personal watercraft 200 can control the amount of the stream of water being supplied to the vehicle 10 thereby controlling the amount of water being discharged out of the vehicle 10 and the thrust created by the stream of water. If the operator of the personal watercraft 200 simply stops the stream of water (by letting of the throttle of the personal watercraft 200), the vehicle 10 will stop being supplied with a pressurize source of water.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A vehicle that can ride on a surface of water and be propelled into the air above the surface of the water, the vehicle comprising:

a main body;

a board provided on the bottom of the main body;

a seat;

an inlet for receiving a pressurized incoming water stream from a water source;

a main nozzle positioned to direct a flow of water beneath the board;

handlebars having a first handle conduit and a second handle conduit, each handle conduit ending in a handle nozzle for discharging a flow of water out of the handle conduit and rotatable relative to the vehicle; and conduits supported by the main body, the conduits connected to the inlet and positioned to route a first portion of the incoming water stream to the main nozzle and a second portion of the incoming water stream to the handlebars, wherein the handle conduits curve along their length so that the handle nozzles are positioned in planes substantially parallel to a center line of the vehicle.

2. The vehicle of claim 1 wherein the conduits comprise a main conduit connected between the inlet and the main nozzle to direct the first portion of the water stream to the main nozzle and a second conduit having an inlet end positioned within the main conduit to direct the second portion of the water stream to the handlebars.

3. The vehicle of claim 2 further comprising a manifold connected to the second conduit that directs the second portion of the incoming water stream to the handlebars.

4. The vehicle of claim 3 wherein the main conduit is curved along its length such that the main conduit curves from the inlet which is provided at a rear of the vehicle to the main nozzle.

5. The vehicle of claim 1 further comprising a plate positioned between the board and the inlet.

6. The vehicle of claim 1 further comprising a main straightening vane positioned inside the main conduit proximate the outlet.

7. The vehicle of claim 6 wherein the main straightening vane comprises a plurality of vane members extending radially from a spindle so that the vane members are positioned substantially parallel with a flow of water being directed through the straightening vane.

8. The vehicle of claim 1 wherein the first handle conduit is independently rotatable from the second handle conduit.

9. The vehicle of claim 1 further comprising handles extending from the handle conduits to allow a rider to rotate the handle conduits.

10. The vehicle of claim 1 wherein the planes the handle nozzles are positioned in are substantially parallel to one another.

11. The vehicle of claim 10 wherein the handle nozzles can be rotated in these planes.

12. The vehicle of claim 11 wherein the handle nozzles can be rotated through 360° in these planes.

* * * * *